US012471627B2

(12) United States Patent
Wei Yim

(10) Patent No.: US 12,471,627 B2
(45) Date of Patent: Nov. 18, 2025

(54) AEROSOL-GENERATING DEVICE WITH MOVABLY ATTACHED MOUTHPIECE

(71) Applicant: PHILIP MORRIS PRODUCTS S.A., Neuchatel (CH)

(72) Inventor: Jun Wei Yim, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 468 days.

(21) Appl. No.: 17/606,540

(22) PCT Filed: Apr. 24, 2020

(86) PCT No.: PCT/EP2020/061547

§ 371 (c)(1),
(2) Date: Oct. 26, 2021

(87) PCT Pub. No.: WO2020/221674

PCT Pub. Date: Nov. 5, 2020

(65) Prior Publication Data

US 2022/0202072 A1 Jun. 30, 2022

(30) Foreign Application Priority Data

Apr. 29, 2019 (EP) ..... 19171608

(51) Int. Cl.
*A24F 40/10* (2020.01)
*A24F 40/40* (2020.01)
*A24F 40/53* (2020.01)

(52) U.S. Cl.
CPC ..... *A24F 40/10* (2020.01); *A24F 40/40* (2020.01); *A24F 40/53* (2020.01)

(58) Field of Classification Search
None
See application file for complete search history.

(56) References Cited

U.S. PATENT DOCUMENTS 5,186,173 A 2/1993 Zuckerman
8,833,363 B2 9/2014 Masada
(Continued)

FOREIGN PATENT DOCUMENTS

JP 3212997 7/2001
JP 3212811 9/2001
(Continued)

OTHER PUBLICATIONS

PCT Search Report and Written Opinion for PCT/EP2020/061547 dated Jul. 9, 2020 (14 pages).
(Continued)

*Primary Examiner* — Philip Y Louie
*Assistant Examiner* — John Mitchell Martin
(74) *Attorney, Agent, or Firm* — Mueting Raasch Group

(57) ABSTRACT

The invention relates to an aerosol-generating device comprising a mainbody (10) and a mouthpiece (12). The main body comprises a heating chamber (14) for receiving an aerosol-forming substrate. The mouthpiece is movably connected to the main body. The mouthpiece is configured movable with respect to the main body in a first movement between a first position and a second position. The first position is an operation position of the aero sol-generating device. In the second position, the heating chamber is at least partially exposed. The mouthpiece is configured movable with respect to the main body in a second movement between the second position and a third position. The second movement of the mouthpiece from the second position to the third position is configured to trigger an event.

18 Claims, 4 Drawing Sheets

(56) References Cited

U.S. PATENT DOCUMENTS

| | | | | |
|---|---|---|---|---|
| 9,936,735 | B1 | 4/2018 | Shotey | |
| 10,206,428 | B2 | 2/2019 | Thorens | |
| 10,292,424 | B2 | 5/2019 | Brammer | |
| 10,470,491 | B2 | 11/2019 | Sutton | |
| 2007/0045288 | A1* | 3/2007 | Nelson | A61M 11/041 219/533 |
| 2007/0125765 | A1 | 6/2007 | Nelson | |
| 2008/0016636 | A1* | 1/2008 | Morris | B25G 3/28 15/145 |
| 2013/0042865 | A1* | 2/2013 | Monsees | A61M 15/06 128/203.27 |
| 2013/0152927 | A1* | 6/2013 | Baillet | A61M 15/0026 128/203.15 |
| 2015/0157056 | A1 | 6/2015 | Bowen | |
| 2015/0245668 | A1* | 9/2015 | Memari | H05K 999/00 206/250 |
| 2017/0055583 | A1 | 3/2017 | Blandino | |
| 2018/0153219 | A1* | 6/2018 | Verleur | A24F 40/40 |
| 2018/0289906 | A1* | 10/2018 | Trzecieski | A24F 40/40 |
| 2018/0295881 | A1* | 10/2018 | Mironov | A24F 40/70 |
| 2019/0069606 | A1* | 3/2019 | Qiu | A24F 40/40 |
| 2019/0098930 | A1 | 4/2019 | Fallon | |
| 2022/0039465 | A1* | 2/2022 | Du | A24F 40/30 |

FOREIGN PATENT DOCUMENTS

| | | |
|---|---|---|
| JP | 2016511640 | 4/2016 |
| RU | 2342948 | 1/2009 |
| RU | 2661840 | 7/2018 |
| RU | 2678892 | 2/2019 |
| UZ | 2238 | 12/2002 |
| WO | WO 2015/175979 | 11/2015 |
| WO | WO 2018/141699 | 8/2018 |
| WO | WO 2018/146071 | 8/2018 |

OTHER PUBLICATIONS

Office Action issued in Russia for Application No. 2021133860 dated Apr. 15, 2022 (5 pages).

Office Action issued in Japan for Application No. 2021-563347 dated Nov. 9, 2022 (4 pages). English translation included.

* cited by examiner

Fig. 1
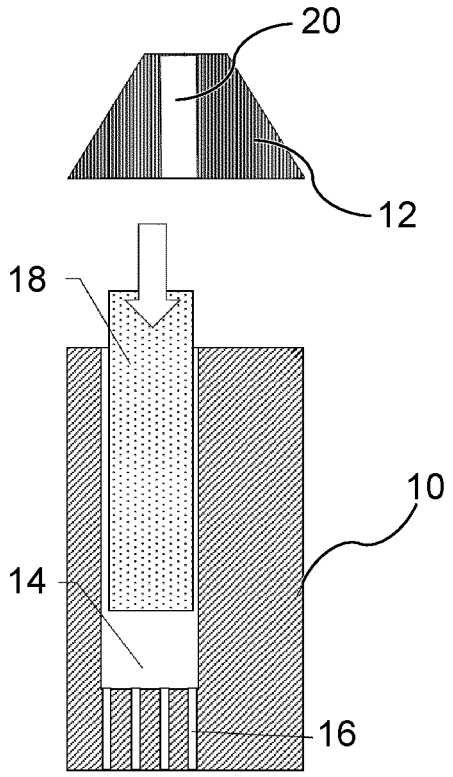
Fig. 1A
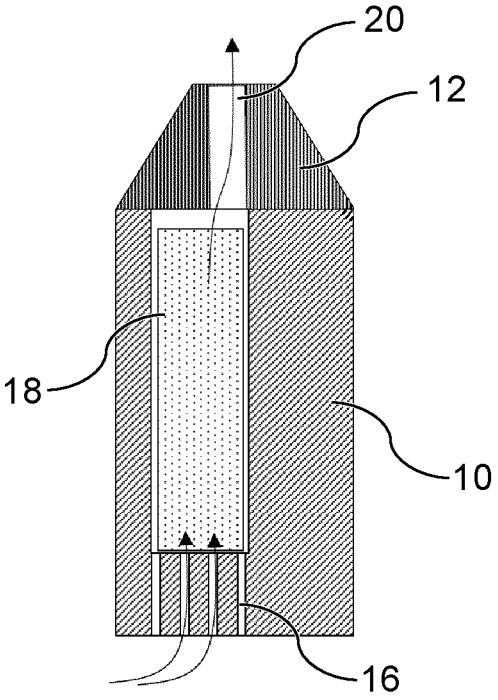
Fig. 1B

Fig. 2
Fig. 2A
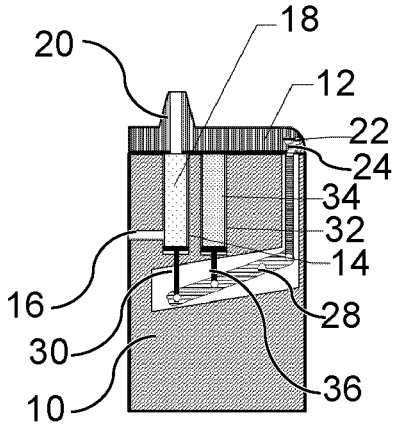
Fig. 2B
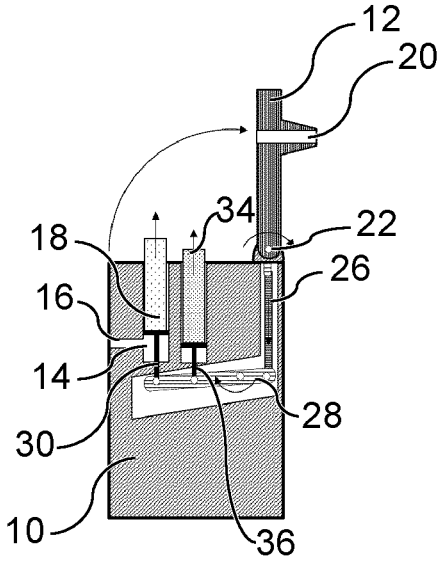
Fig. 2C
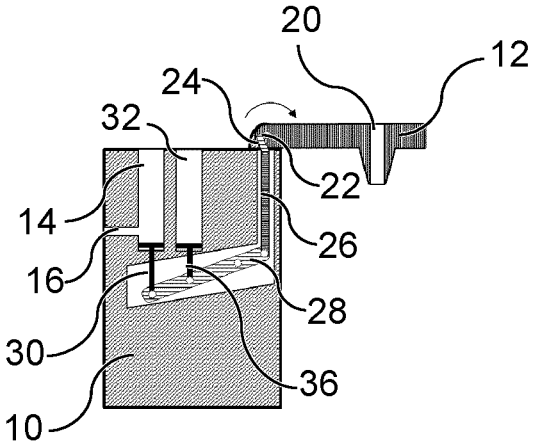

Fig. 4
Fig. 4A
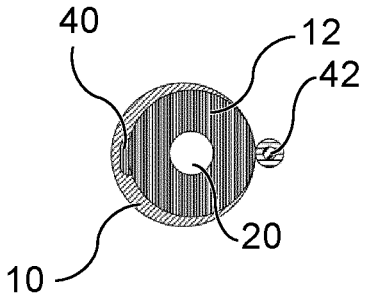
Fig. 4B
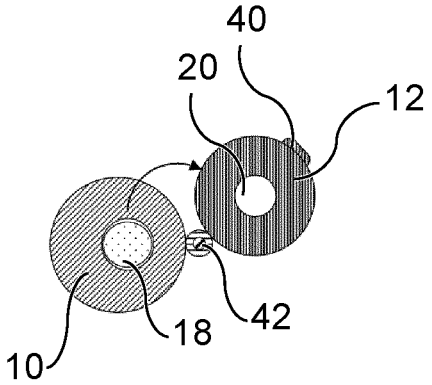
Fig. 4C
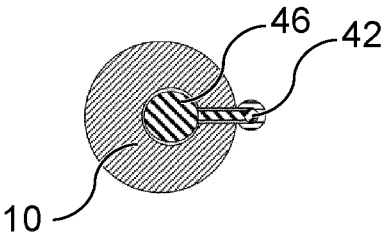

AEROSOL-GENERATING DEVICE WITH MOVABLY ATTACHED MOUTHPIECE

This application is a U.S. National Stage Application of International Application No. PCT/EP2020/061547 filed Apr. 24, 2020, which was published in English on Nov. 5, 2020, as International Publication No. WO 2020/221674 A1. International Application No. PCT/EP2020/061547 claims priority to European Application No. 19171608.3 filed Apr. 29, 2019.

The present invention relates to an aerosol-generating device.

It is known to provide an aerosol-generating device for generating an inhalable vapor. Such aerosol-generating devices may heat an aerosol-forming substrate without burning the aerosol-forming substrate. Such aerosol-forming substrates may be provided as part of an aerosol-generating article. Such aerosol-generating devices may be arranged to receive an aerosol-generating article comprising an aerosol-forming substrate. The aerosol-generating article may have a rod shape for insertion of the aerosol-generating article into a heating chamber of the aerosol-generating device. A heating element may be arranged in or around the heating chamber for heating the aerosol-forming substrate when the aerosol-generating article is received in the heating chamber of the aerosol-generating device. Typically, the aerosol-forming substrate is vaporized by the heating element and aerosol is subsequently formed. The aerosol-generating device may comprise a mouthpiece. A user may inhale the generated aerosol through the mouthpiece. The mouthpiece may be arranged at a proximal end of the heating chamber. It may be difficult to retrieve the aerosol-generating article from the heating chamber, after use of the aerosol-generating article. It may also be difficult to access the heating chamber in general, for example for cleaning the heating chamber or the replace or repair one or more components of the heating chamber, such as a heating element.

It would be desirable to have an aerosol-generating device with improved aerosol generating article ejection. It would be desirable to have an aerosol-generating device with improved access to the heating chamber. It would be desirable to have an aerosol-generating device with improved cleaning of the heating chamber. It would be desirable to have an aerosol-generating device with improved access to one or more elements of the aerosol-generating device other than the heating chamber.

According to an aspect of the invention there is provided an aerosol-generating device. The aerosol-generating device may comprise a main body. The aerosol-generating device may comprise a mouthpiece. The main body may comprise a heating chamber for receiving an aerosol-forming substrate. The mouthpiece may be movably connected to the main body. The mouthpiece may be configured movable with respect to the main body. The mouthpiece may be configured movable with respect to the main body in a first movement, between a first position and a second position. The first position may be an operation position of the aerosol-generating device. In the second position, the heating chamber may be at least partially exposed. The first movement of the mouthpiece from the first position to the second position may be configured to trigger an event. The mouthpiece may be configured movable with respect to the main body in a second movement. The second movement may be between the second position and a third position. In some embodiments, the third position may be the same position as the first position. The second movement of the mouthpiece from the second position to the third position may be configured to trigger an event.

According to an aspect of the invention there is provided an aerosol-generating device comprising a main body and a mouthpiece. The main body comprises a heating chamber for receiving an aerosol-forming substrate. The mouthpiece is movably connected to the main body. The mouthpiece is configured movable with respect to the main body in a first movement between a first position and a second position. The first position is an operation position of the aerosol-generating device. In the second position, the heating chamber is at least partially exposed. The mouthpiece is configured movable with respect to the main body in a second movement between the second position and a third position. The second movement of the mouthpiece from the second position to the third position is configured to trigger an event.

In some embodiments, the first movement may optionally be configured to trigger an event.

In some embodiments, the third position may be the same position as the first position.

At least partially exposing the heating chamber in the second position may enable access to the heating chamber. At least partially exposing the heating chamber may facilitate removal of an aerosol-generating article from the heating chamber after use. At least partially exposing the heating chamber may facilitate insertion of an aerosol-generating article to the heating chamber before use. At least partially exposing the heating chamber may facilitate replacement of a used or at least partially used aerosol-generating article after use. At least partially exposing the heating chamber may enable access to a heating element disposed in the heating chamber. At least partially exposing the heating chamber may be realized by exposing an opening to the heating chamber. One or both of the aerosol-forming substrate and an aerosol-generating article comprising the aerosol-forming substrate may be received in the heating chamber, when the heating chamber is at least partially exposed. At least partially exposing the heating chamber may enable access to one or both of the aerosol-forming substrate and the aerosol-generating article. Exemplarily, aerosol-forming substrate or the aerosol-generating article may be removed or ejected from the heating chamber after use in the second position of the mouthpiece. In the second position of the mouthpiece, at least one side of the heating chamber may be fully exposed.

In addition to at least partially exposing the heating chamber in the second position, an event is triggered by the second movement of the mouthpiece, in which the mouthpiece is moved from the second position to the third position. The movement of the mouthpiece may thus be utilized to enable two functionalities, namely at least partially exposing the heating chamber and triggering an event. The first and second movements are distinct movements.

As used herein, an 'aerosol-generating device' relates to a device that interacts with an aerosol-forming substrate to generate an aerosol. The aerosol-forming substrate may be part of an aerosol-generating article. For example, the aerosol-forming substrate may be part of a smoking article. An aerosol-generating device may be a smoking device that interacts with an aerosol-forming substrate of an aerosol-generating article to generate an aerosol. The generated aerosol may be an aerosol that is directly inhalable into a user's lungs thorough the user's mouth. An aerosol-generating device may be a holder. The aerosol-generating device may be an electrically heated device. The aerosol-generating device may be an electrically heated smoking device. The aerosol-generating device may comprise a housing. The aerosol-generating device may comprise electric circuitry. The aerosol-generating device may comprise a power supply. The aerosol-generating device may comprise the heating chamber. The aerosol-generating device may comprise a heating element. The electric circuitry, the power supply, the heating chamber and the heating element are preferably arranged in a main body of the aerosol-generating device. The aerosol-generating device may comprise a liquid storage portion for storing liquid aerosol-forming substrate. If access to the heating chamber is described in this disclosure, this access may alternatively referred to access to the liquid storage portion. New liquid aerosol-forming substrate may be provided into the liquid storage portion, when access to the liquid storage portion is facilitated.

As used herein, the term 'aerosol-generating article' refers to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. A smoking article comprising an aerosol-forming substrate comprising tobacco may be referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at a downstream end of the aerosol-generating article. The filter plug may be a cellulose acetate filter plug. The filter plug is approximately 7 mm in length in one aspect, but may have a length of between approximately 5 mm to approximately 10 mm.

In one aspect, the aerosol-generating article has a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise combining one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In a particularly preferred aspect, the aerosol-forming substrate comprises a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain aspects, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The aerosol-forming substrate may also be provided in a liquid form. The liquid aerosol-forming substrate may comprise other additives and ingredients, such as flavourants. The liquid aerosol-forming substrate may comprise water, solvents, ethanol, plant extracts and natural or artificial flavours. The liquid aerosol-forming substrate may comprise nicotine. The liquid aerosol-forming substrate may have a nicotine concentration of between about 0.5% and about 10%, for example about 2%. The liquid aerosol-forming substrate may be contained in a liquid storage portion of the aerosol-generating article, in which case the aerosol-generating article may be denoted as a cartridge.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The aerosol-generating device may comprise a power supply, typically a battery, within a main body of the aerosol-generating device. In one aspect, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

In all of the aspects of the disclosure, the heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The heating element may be part of the aerosol-generating device. The aerosol-generating device may comprise an internal heating element or an external heating element, or both internal and external heating elements, where "internal" and "external" refers to the aerosol-forming substrate. An internal heating element may take any suitable form. For example, an internal heating element may take the form of a heating blade. Alternatively, the internal heater may take the form of a casing or substrate having different electro-conductive portions, or an electrically resistive metallic tube. Alternatively, the internal heating element may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such aspect, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The internal or external heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one aspect, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The heating element advantageously heats the aerosol-forming substrate by means of conduction. The heating element may be at least partially in contact with the substrate, or the carrier on which the substrate is deposited. Alternatively, the heat from either an internal or external heating element may be conducted to the substrate by means of a heat conductive element.

During operation, the aerosol-forming substrate may be completely contained within the aerosol-generating device. In that case, a user may puff on the mouthpiece of the aerosol-generating device.

The mouthpiece may be removably connected to the main body by any known connection means. Preferably, the mouthpiece is connected with the main body by means of a hinge.

When the mouthpiece is in the second position, the device may be configured to facilitate access to the heating chamber. In the second position of the mouthpiece, an aerosol-generating article may be inserted into or removed from the heating chamber.

When the mouthpiece is in the second position, the device may be configured to facilitate cleaning of the heating chamber. In the second position of the mouthpiece, access to the heating element arranged in the heating chamber may be enabled for cleaning of the heating element. The heating element may be manually cleaned by inserting a cleaning tool such as a brush into the heating chamber. Preferably, access to the heating element may be facilitated after removal of a used aerosol-generating article. After removal of a used aerosol-generating article, a user may manually clean the heating element and afterwards insert a new aerosol-generating article into the heating chamber. Alternatively or additionally, one or more of the heating element and the heating chamber may be automatically cleaned during the first movement of the mouthpiece. Preferably, the aerosol-generating device may comprise a cleaning element such as a scraping element configured to scrape unwanted constituents off of one or more of the heating element and the inner wall of the heating chamber. The cleaning element is preferably mechanically connected with the mouthpiece such that the first movement of the mouthpiece moves the cleaning element. Alternatively, the cleaning element may be electrically actuated, for example by means of a linear motor. The cleaning element may have a shape adapted to the shape of one or more of the heating element and the heating chamber. The cleaning element may have a circular shape contacting the inner wall of the heating chamber. The cleaning elements may be configured to be moved along the longitudinal axis of the heating chamber.

When the mouthpiece is in the second position, the device may be configured to facilitate display of information regarding the aerosol-generating device. The display of information may be an optical or haptic display of information. The information may include a status of depletion of the aerosol-generating article. A display may be provided to display the information. The display may be arranged on the outside of the aerosol-generating device. The display may be arranged on the outside of the main body of the aerosol-generating device. Alternatively or additionally, a secondary device may be utilized for displaying deformation. The aerosol-generating device may comprise a communication interface to enable information transfer between the aerosol-generating device and the secondary device. The secondary device may be a mobile device such as a smartphone or tablet. The displayed information may comprise different parameters such as the status of a cleaning operation, the number of puffs remaining and the temperature in the heating chamber.

When the mouthpiece is in the second position, the device may be configured to facilitate access to elements of the aerosol-generating device apart from the heating chamber. Access may be facilitated to the power supply of the aerosol-generating device. This may enable recharging or replacement or repair of the power supply. An opening may be provided to access the elements of the aerosol-generating device in the second position of the mouthpiece.

When the mouthpiece is in the second position, the device may be configured to facilitate one or more of access to the heating chamber, cleaning of the heating chamber, display of information regarding the aerosol-generating device and access to elements of the aerosol-generating device apart from the heating chamber. Access to the further elements may be facilitated through the heating chamber. Access to the further elements may be facilitated through a further opening apart from the heating chamber, preferably from the side of the aerosol-generating device.

The aerosol-generating device may comprise a reserve receptacle. The reserve receptacle may be configured to hold a new aerosol-generating article. The reserve receptacle may be arranged close to the heating chamber. The reserve receptacle may be arranged at the same side of the aerosol-generating device. The reserve receptacle may have a shape such that an aerosol-generating article may be accommodated in the reserve receptacle. The reserve receptacle may be utilized to retrieve a new aerosol-generating article after use of the aerosol-generating article in the heating chamber. In the second position of the mouthpiece, access to the heating chamber and to the reserve receptacle may be facilitated. A user may remove the used aerosol-generating article from the heating chamber and place the new aerosol-generating article from the reserve receptacle into the heating chamber. Additionally, a user may place a further new aerosol-generating article into the reserve receptacle.

By means of the first movement, the aerosol-generating article may be at least partially ejected from the heating chamber. For this purpose, the aerosol-generating device may comprise an ejection mechanism. The ejection mechanism may be a mechanical ejection mechanism or an electrical ejection mechanism. In the second position of the mouthpiece, the aerosol-generating article may be at least partly ejected from the heating chamber. At least partly ejecting the used aerosol-generating article may simplify gripping and removing of the aerosol-generating article by a user. Alternatively or additionally, the new aerosol-generating article positioned in the reserve receptacle may be at least partly ejected by means of the first movement. In the second position of the mouthpiece, the new aerosol-generating article may be at least partly ejected from the reserve receptacle. The same or a further ejection mechanism may be utilized for at least partly ejecting the new aerosol-generating article from the reserve receptacle. The ejection mechanism may be configured to encompass the cleaning element described herein. Preferably, the ejection mechanism has a double functionality. The first functionality may be to at least partly eject one or more of the used aerosol-generating article from the heating chamber and the new aerosol-generating article from the reserve receptacle. The second functionality may be to move the cleaning element so as to at least partially clean one or more of the heating element and the heating chamber.

In the first position, the mouthpiece may close the heating chamber. The mouthpiece may close the heating chamber except for an air outlet. The air outlet may be utilized for aerosol to flow through the air outlet and through the mouthpiece towards the mouth of the user. The first position may thus be an operation position.

The mouthpiece may be arranged at the proximal end of the device. Instead of the mouthpiece, a cover flap, a handle or a cap may be movably attached to the main body. As used herein, the terms 'upstream', 'downstream', 'proximal' and 'distal' are used to describe the relative positions of components, or portions of components, of the aerosol-generating device in relation to the direction in which a user draws on the aerosol-generating device during use thereof.

In use, a generated aerosol may exit the aerosol-generating device through the mouthpiece towards a user. The mouthpiece may also be referred to as the proximal end. In use, a user may draw on the proximal end or mouthpiece of the aerosol-generating device in order to inhale the aerosol generated by the aerosol-generating device. The aerosol-generating device comprises a distal end opposed to the proximal end or mouthpiece. The proximal end or mouthpiece of the aerosol-generating device may also be referred to as the downstream end and the distal end of the aerosol-generating device may also be referred to as the upstream end. Components, or portions of components, of the aerosol-generating device may be described as being upstream or downstream of one another based on their relative positions between the proximal end, downstream end or mouthpiece and the distal end or upstream end of the aerosol-generating device.

The mouthpiece may be configured such that the first movement of the mouthpiece occurs before the second movement of the mouthpiece. The mouthpiece may be configured such that the first and second movement may occur at the same time.

In addition to the functionality enabled by the first movement, at the end of which the mouthpiece is positioned in the second position, the mouthpiece is configured to trigger an event by means of or after the second movement, at the end of which the mouthpiece is positioned in the third position.

The event may comprise at least partial ejection of the used aerosol-generating article. Particularly if access to the heating chamber is enabled in the second position of the mouthpiece, it is preferred that at least partial ejection of the used aerosol-generating article is facilitated by means of the second movement of the mouthpiece. The event may comprise full ejection of the used aerosol-generating article. Removal of the aerosol-generating article may in this way be simplified.

For at least partly ejecting the used aerosol-generating article, an ejection mechanism as described herein may be utilized. The ejection mechanism may be configured as a mechanical ejection mechanism. Alternatively, the ejection mechanism may be configured as an electrical ejection mechanism. The aerosol-generating device may comprise mechanical means for converting one or both of the first movement of the mouthpiece and the second movement of the mouthpiece to a linear movement of one or more components of the aerosol-generating device, particularly of the ejection mechanism. The linear movement may also be referred to as a translational movement. The ejection mechanism may be configured to move along or parallel to the longitudinal axis of the aerosol-generating device.

The event may comprise at least partial ejection of the heating element. Partly ejecting the heating element may simplify one or more of removal of the aerosol-generating article, cleaning of the heating element, repair of the heating element and replacement of the heating element. At least partly ejecting the heating element may be facilitated by the ejection mechanism as described herein. Preferably, the heating element may be at least partly ejected together with at least partly ejecting the used aerosol-generating article.

The event may comprise at least partial ejection of the heating chamber. Partly ejecting the heating chamber may simplify one or more of removal of the aerosol-generating article, cleaning of the heating chamber, repair of the heating chamber and replacement of the heating chamber. At least partly ejecting the heating chamber may be facilitated by the ejection mechanism as described herein. Preferably, the heating chamber may be at least partly ejected together with at least partly ejecting the heating element and the used aerosol-generating article.

The event may comprise initiation of a cleaning cycle of the heating chamber. This aspect is particularly preferred, if the third position is identical to the first position. In other words, this aspect is particularly preferred if the mouthpiece is returned to the first position during the second movement.

During the cleaning cycle, unwanted residues may be removed from one or both of the heating chamber and the heating element.

The event may comprise initiation of a pyrolysis cleaning cycle of the heating chamber. This aspect is particularly preferred, if the third position is identical to the first position. Pyrolysis may be enabled after the mouthpiece is placed again in the first position. After operation of the aerosol-generating device, unwanted residues from the aerosol-generating substrate may remain in the heating chamber or on the heating element or both. The unwanted residues may comprise or consist of organic compounds. Thermal liberation of organic compounds may occur by pyrolysis. Pyrolysis is a process in which chemical compounds decompose due to the action of heat. Organic compounds generally pyrolyse to form organic vapors and liquids, which may migrate away from the heating element leaving it in a cleaned state. The controller may be programmed to actuate the heating element through a first thermal cycle in which the temperature of the heating element may be raised to a first temperature of about 375 degrees centigrade. This may allow the formation of an aerosol from the aerosol-forming substrate disposed in proximity to the heating element. The controller may further be programmed to actuate the heating element through a second thermal cycle in which the temperature of the heating element may be raised to a second temperature of about 550 degrees centigrade for a period of about 30 seconds. This may allow organic material deposited on the heating element or the heating chamber to decompose or pyrolyse.

The event may comprise initiation of a signal from the controller to output one or more pieces of information as described herein on the user interface.

The event may comprise one or more, particularly multiple, of at least partial ejection of the used consumable, at least partial ejection of a heating element of the heating chamber, at least partial ejection of the heating chamber, initiation of a cleaning cycle of the heating chamber, initiation of a pyrolysis cleaning cycle of the heating chamber and initiation of a signal from a controller to output one or more pieces of information on a user interface.

The second position may be an intermediate position between the first position and the third position. In some aspects, the third position may be the same as the first position. Exemplarily, the first movement may be a pivotal movement of the mouthpiece through 180 degrees to enable access to the heating chamber. The second movement may be a continuation of the pivotal movement of the mouthpiece through another 180 degrees. The total pivotal movement after the first and the second movement in the same direction may be a total rotation of 360 degrees. Alternatively, a reverse pivotal movement may be facilitated during the second movement for a total net rotation of 0 degrees. As a consequence, the mouthpiece may be configured to close the heating chamber in both the first and the third position and may be configured to enable access to the heating chamber in the second position. In the third position, pyrolysis cleaning may be initiated.

By means of the two part movement of the mouthpiece, a user may have a haptic feedback regarding the movements. Consequently, the user may move the mouthpiece and identify the positions of the mouthpiece and thus the current functionality without having to look at the mouthpiece. The first movement may cover a first distance and the second movement may cover a second distance. The two movements may be in the same direction. The aerosol-generating device may be configured such that a mechanical resistance is created in the second position so that the user experiences a haptic feedback, when the mouthpiece is in the second position.

The mouthpiece may be pivotally attached to the main body. The pivotal attachment between the main body and the mouthpiece may be facilitated by means of a hinge. The mouthpiece may be configured to be pivoted away from the heating chamber. A user may open the mouthpiece with a finger such as a thump. The attachment between the mouthpiece and the main body may be permanent. The mouthpiece may be attached to an edge of the proximal end of the main body. The pivotal attachment may enable a pivotal movement of the mouthpiece with respect to the main body. A pivotal movement may also be referred to as a rotational movement.

The first and second movements may be a same type of movement. The first and second movements may be pivotal movements. By configuring the movements as being from the same type, performing the movements may be simplified. The two movements may have different haptic characteristics to differentiate the movements. Exemplarily, both movements may comprise a mechanical resistance. The second movement may have a higher mechanical resistance than the first movement or vice versa.

Alternatively, the first and second movements may be different types of movements. Exemplarily, the first movement may be a pivotal movement and the second movement may be a linear movement or vice versa.

Both the first and the second movements may be linear movements. The first movement may be a sliding movement perpendicular to the longitudinal axis of the aerosol-generating device to at least partly expose the heating chamber. The second movement may be a sliding movement along or transversal with respect to the longitudinal axis of the aerosol-generating device to at least partly eject the used aerosol-generating article from the heating chamber.

Instead of partly exposing the heating chamber in the second position by means of the mouthpiece, a different part than the mouthpiece may be moved to partly expose the heating chamber.

If the first movement is a pivotal movement, the angle between the mouthpiece in the first position and the mouthpiece and the second position may be 90°. Access to the heating chamber for removal and insertion of the aerosol-generating articles may be facilitated in this way. In the first position, the mouthpiece may be positioned in a horizontal position. After the rotation to the second position, the mouthpiece may be arranged in a vertical position. Consequently, the first movement may be a pivotal movement from a horizontal to a vertical position.

If the second movement is a pivotal movement, the angle between the mouthpiece in the second position and the mouthpiece and the third position may be 90°. During or after the second movement, the event is triggered. By means of the second movement, the mouthpiece may be moved from a vertical position to a horizontal position again. The first and second movements together may result in a 180° movement of the mouthpiece. In the third position, the mouthpiece may be positioned again in the first position. Alternatively, in the third position, the mouthpiece is rotated 180° with respect to the first position. In the third position, the mouthpiece may be completely flipped open in comparison with the first position.

The pivotal movement may comprise a movement of the mouthpiece about a pivoting axis. The pivoting axis may be a longitudinal axis, which longitudinal axis may be an axis along the longitudinal length of the aerosol-generating device. The pivoting axis may be a transverse axis, which transverse axis may be transverse to a longitudinal axis of the device. The pivoting axis may be a central longitudinal axis of the aerosol generating device. The central longitudinal axis may run through the geometric center or center of gravity of the aerosol-generating device. The hinge may be configured in a vertical arrangement to enable a pivoting movement of the mouthpiece about the longitudinal axis or central longitudinal axis. The hinge may be configured in a horizontal arrangement to enable a pivoting movement of the mouthpiece about the transverse axis.

The mouthpiece may comprise a sliding element. The first movement may be a pivotal movement and the second movement may be a sliding movement or vice versa. The sliding movement is preferably a linear movement. Consequently, different types of movements may be combined. A pivotal movement may move the mouthpiece away from the heating chamber to enable access to the heating chamber. A sliding movement as second movement of the mouthpiece may easily be differentiated by user from the first movement.

For facilitating the sliding movement, the aerosol-generating device may comprise a sliding element. The sliding element may comprise a sliding shaft. The mouthpiece may be configured to slide along the sliding shaft. The sliding shaft may be arranged along or parallel to the longitudinal axis or central longitudinal axis of the aerosol-generating device. Hence, the sliding element may be configured in a vertical arrangement. Alternatively, the sliding element may be configured in a horizontal arrangement to enable a sliding movement along or parallel to the transverse axis.

The mouthpiece may comprise a base support. The base support may be arranged at the base of the heating chamber, when the mouthpiece is in the first position. During the sliding movement, the base support may eject an aerosol-generating article from the heating chamber. In this regard, the base support may be arranged upstream of the aerosol-generating article and in contact with the aerosol-generating article so that linear movement of the mouthpiece may at the same time move the aerosol-generating article. For facilitating the pivotal movement during the first movement, the hinge may be provided between the mouthpiece and the main body of the aerosol-generating device. The mouthpiece may comprise the sliding element for facilitating the subsequent sliding movement during the second movement. If the first movement is configured as a sliding movement, the sliding element may be arranged between the main body and the mouthpiece and configured such that the mouthpiece may be slidably attached to the main body. In this case, the mouthpiece preferably comprises the hinge to enable a pivotal movement during the second movement.

The sliding element may comprise a stopper for limiting the sliding movement.

In a further aspect, a rotational and a linear movement may be combined. Exemplarily, rotation of the mouthpiece may result in the heating element being rotated to scrape off unwanted constituents from the inner side wall of the heating chamber while at the same time a linear movement of the mouthpiece may be utilized to access the heating chamber. The heating element may in this aspect beneficially be configured as a mesh heater, preferably a tubular mesh heater, preferably arranged adjacent the inner side wall of the heating chamber.

The mouthpiece may be configured to trigger the event during or in response to the second movement by using mechanical energy of the first movement. According to this aspect, no electrical energy from the power supply may be necessary to facilitate triggering of the event. Preferably, the event is facilitated by using mechanical energy of the first movement. Triggering of the events or the event itself may be facilitated by using mechanical energy of the second movement. Particularly, mechanical means as described herein may be utilized for using mechanical energy of one or both of the first movement of the second movement for the event. The device may comprise a crankshaft connected with the mouthpiece for converting a pivotal movement of the mouthpiece to a linear movement of a lever rod connected to the crankshaft. The lever rod may be configured for at least partly facilitating an ejection of the aerosol-generating article from the heating chamber. Ejection of the aerosol-generating article may thus be improved. The ejected aerosol-generating article may easily be gripped and removed by a user. By means of the lever rod, a lever action may be facilitated to define the degree of ejection of the aerosol-generating article. The crankshaft may enable a reverse movement of the mouthpiece to lower a new aerosol-generating article back into heating chamber upon movement from the mouthpiece into the third position, preferably back to the first position. The mechanical means may exemplarily comprise the crankshaft and the lever rod to convert the pivotal movement of the mouthpiece to a linear movement of the ejection mechanism to eject one or more of the used aerosol-generating article, a new aerosol-generating article in the reserve receptacle, the heating element and the heating chamber.

The aerosol-generating device may comprise the power supply and a sensing means. The sending means may be configured to detect one or both of the first movement and the second movement. The aerosol-generating device may be configured to trigger the event by using electrical energy of the power supply. Operation may be simplified by using electrical energy of the power supply. Particularly, comfortable use of the aerosol-generating device may be achieved by using the electrical energy of the power supply for triggering the event. The power supply may be used for powering the heating element and at the same time for triggering of the event. The aerosol-generating device may comprise an electric motor controlled by the controller to move one or both of the ejection means and the mechanical means. The controller may be configured to control operation of the electric motor, when the sensing means detects one or both of the first movement and the second movement.

The device may comprise a temperature sensing means configured to measure the temperature inside of the heating chamber. The controller may be configured to prevent movement of the mouthpiece, preferably the first movement, if the temperature sensing means detects that the temperature within the heating chamber exceeds a predetermined threshold. The sensing means may be configured as a sensor. The sensing means may be configured as the heating element, wherein the electrical resistance of the heating element may be measured and utilized by the controller to determine the temperature of the heating element. Prevention of the first movement may prevent the user from experiencing an unwanted high temperature, if the heating chamber and as a consequence the mouthpiece is too hot. Preventing the movement may be beneficial if a pyrolysis cleaning as described herein is utilized. In this regard, the heating chamber may be heated to a high temperature during the pyrolysis cleaning. During the pyrolysis cleaning and preferably for a predetermined timeframe after the completion of the pyrolysis cleaning, the mouthpiece may thus be prevented from being moved.

The invention may also relate to a method for moving a mouthpiece of an aerosol-generating device, comprising:

providing an aerosol-generating device as described herein, moving the mouthpiece by the first movement from the first position to the second position, thereby at least partially exposing the heating chamber, and moving the mouthpiece by the second movement from the second position to the third position, thereby triggering an event.

The invention may further relate to an aerosol-generating system comprising an aerosol-generating device as described herein and an aerosol-generating article as described herein.

The invention may further relate to an aerosol-generating device. The aerosol-generating device may comprise a main body. The aerosol-generating device may comprise a mouthpiece. The main body may comprise a heating chamber for receiving an aerosol-forming substrate. The mouthpiece may be movably connected to the main body. The mouthpiece may be configured movable with respect to the main body. The mouthpiece may be configured movable with respect to the main body in a first movement, between a first position and a second position. The first position may be an operation position of the aerosol-generating device. In the second position, the heating chamber may be at least partially exposed. The first movement of the mouthpiece from the first position to the second position may be configured to trigger an event as described herein. The first movement of the mouthpiece from the first position to the second position may be configured to trigger an electric event as described herein. The first movement of the mouthpiece from the first position to the second position may be configured to trigger one or more of pyrolysis as described herein and stop of power supply to a heating element as described herein. The first movement of the mouthpiece from the first position to the second position may be configured to trigger one or more of the following events as described herein: access to the heating chamber; cleaning of the heating chamber; display of information regarding the aerosol-generating device; access to elements of the aerosol-generating device apart from the heating chamber; at least partial ejection of the used aerosol-generating article; at least partial ejection of a heating element of the heating chamber; at least partial ejection of the heating chamber; initiation of a cleaning cycle of the heating chamber; initiation of a pyrolysis cleaning cycle of the heating chamber; and initiation of a signal from a controller to output one or more pieces of information on a user interface.

The invention may further relate to an aerosol-generating device. The aerosol-generating device may comprise a main body. The aerosol-generating device may comprise a mouthpiece. The main body may comprise a heating chamber for receiving an aerosol-forming substrate. The mouthpiece may be movably connected to the main body. The mouthpiece may be connected to the main body by a hinge. The hinge may enable a pivotal movement between the mouthpiece and the main body. The mouthpiece may be configured movable with respect to the main body. The mouthpiece may be configured movable with respect to the main body in a first movement, between a first position and a second position. The first position may be an operation position of the aerosol-generating device. In the second position, the heating chamber may be at least partially exposed. The first movement of the mouthpiece from the first position to the second position may be configured to at least partly eject the aerosol-forming substrate from the heating chamber. The device may comprise first mechanical means. The first mechanical means may be configured for converting a pivotal movement of the mouthpiece to a linear movement of second mechanical means connected to the first mechanical means. The second mechanical means may be configured for converting the linear movement to a pivotal lever movement of third mechanical means connected to the second mechanical means. The third mechanical means may be configured for converting the pivotal lever movement to a linear movement of fourth mechanical means connected to the third mechanical means. The fourth mechanical means may be configured to at least partially eject the aerosol-forming substrate. The mechanical means may enable a reverse movement of the mouthpiece to lower new aerosol-forming substrate back into heating chamber upon movement from the mouthpiece back to the first position. The first mechanical means may be a crankshaft connected with the mouthpiece. The second mechanical means may be a transfer shaft connected with the crankshaft. The third mechanical means may be a lever rod. The fourth mechanical means may be a piston.

Features described in relation to one aspect may equally be applied to other aspects of the invention.

The invention will be further described, by way of example only, with reference to the accompanying drawings in which:

FIGS. 1A and 1B show cross-sectional views of a conventional aerosol-generating device comprising a main body and the mouthpiece;

FIGS. 2A, 2B and 2C show cross-sectional views of an aspect of an aerosol-generating device according to the invention;

Figures 3, 3A, 3B:
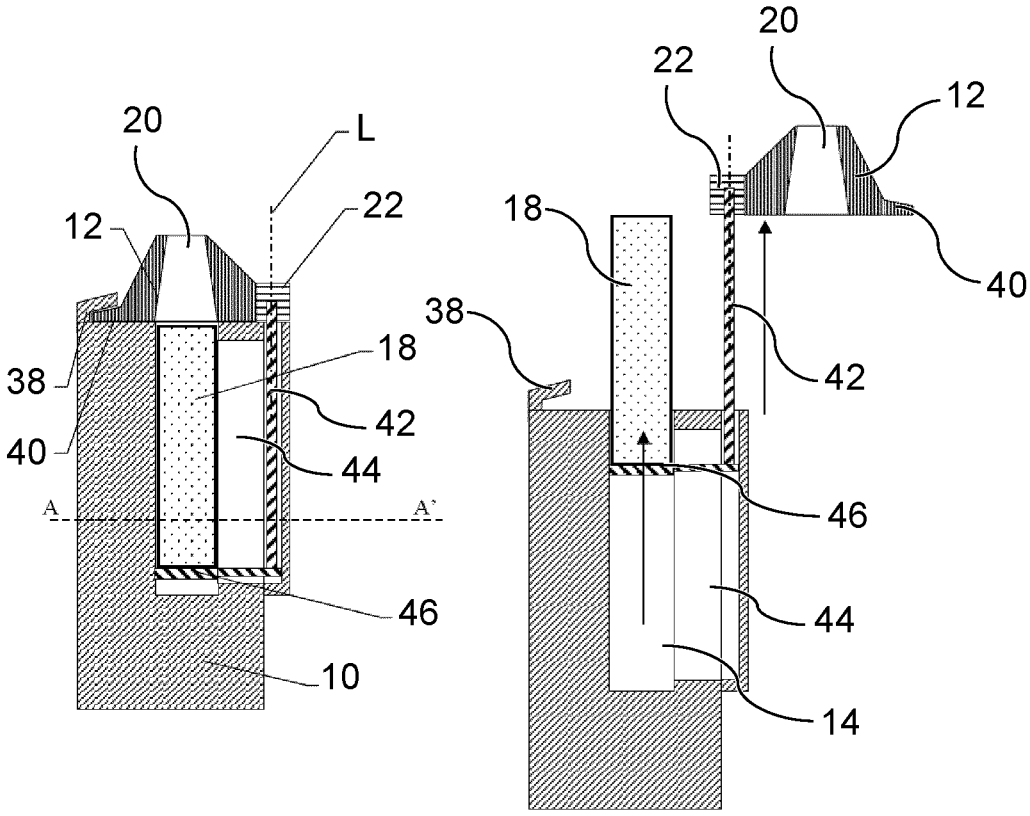

FIGS. 3A, and 3B show cross-sectional views of a further aspect of the aerosol-generating device according to the invention; and FIGS. 4A, 4B and 4C show further cross-sectional views of the aerosol-generating device as depicted in FIGS. 3A and 3B.

FIGS. 1A and 1B show a conventional aerosol-generating device comprising a main body 10 and a mouthpiece 12. The main body 10 comprises multiple elements which are not shown in the figures such as a power supply, control circuitry comprising a controller and a heating element. FIG. 1 shows the heating chamber 14 of the main body 10 as well as air inlets 16. Through the air inlets 16, ambient air may be drawn into the heating chamber 14.

The heating element is configured as an internal heating element, preferably a heating pin or heating blade arranged inside of the heating chamber 14. Alternatively, the heating element may be configured as an external heating element arranged at least partly surrounding the heating chamber 14.

The air inlets 16 are configured to enable airflow into the heating chamber 14. Air flows into the heating chamber 14, through an aerosol-generating article 18 comprising aerosol-forming substrate arranged in the heating chamber 14 and out of the mouthpiece 12 through an air channel 20 of the mouthpiece 12. The airflow through the air inlets 16, heating chamber 14 and air channel 20 of the mouthpiece 12 is indicated by arrows in FIG. 1B.

The mouthpiece 12 is configured connectable to the main body 10. The connection between the mouthpiece 12 and the main body 10 may be facilitated by known means. As can be seen in FIG. 1A, the mouthpiece 12 is detached from the main body 10. In FIG. 1B, the mouthpiece 12 is attached to the main body 10.

FIGS. 2A, 2B and 2C show an aspect of an aerosol-generating device according to the invention. The main elements of the aerosol-generating device are similar to the elements of the aerosol-generating device shown in FIG. 1.

Consequently, only the differences between a conventional aerosol-generating device as shown in FIG. 1 and the aerosol-generating device according to the invention and as depicted in FIG. 2 are described in the following.

The aerosol-generating device shown in FIG. 2 also comprises a main body 10, a mouthpiece 12 and a heating chamber 14 for receiving an aerosol-generating article 18 comprising aerosol-forming substrate. Further, an air inlet 16 is provided for enabling airflow into the heating chamber 14. The mouthpiece 12 comprises an air channel 20 for enabling airflow of ambient air into the air inlet, through the aerosol-generating article 18 received in the heating chamber 14 and through the air channel 20 of the mouthpiece 12. The mouthpiece 12 is movably connected to the main body 10 by means of a hinge 22. The hinge 22 enables a pivotal movement of the mouthpiece 12 around a transverse axis. The transverse axis is perpendicular to a longitudinal axis of the aerosol-generating device.

In addition to the conventional aerosol-generating device shown in FIG. 1, the mouthpiece 12 of the aerosol-generating device depicted in FIG. 2 is movable in a first movement from a first position to a second position. In the second position, the heating chamber 14 is at least partially exposed or open. In some embodiments, the first movement may trigger an event. For example, as shown in FIG. 2B, when the mouthpiece 12 is moved to the second position, the aerosol-generating article 18 is at least partially extracted, ejected lifted or otherwise longitudinally translated from with heating chamber 14. In FIG. 2B, the aerosol-generating article 18 is translated longitudinally so that at a portion of the aerosol-generating article is protruding out from the heating chamber 14. In this way a user may more easily remove the aerosol-generating article 18 from the heating chamber 14. Further, the mouthpiece 12 is movable from the second position to a third position by means of a second movement. The second movement triggers an event. The first position of the mouthpiece 12 is depicted in FIG. 2A. In the first position, the mouthpiece 12 closes the heating chamber 14. In the first position, the mouthpiece 12 is arranged in a horizontal position. In FIG. 2B, the second position of the mouthpiece 12 is depicted. By an arrow in FIG. 2B, the first movement of the mouthpiece 12 from the first position to the second position is indicated. During the first movement, the mouthpiece 12 is pivoted by about 90°. In FIG. 2C, the third position of the mouthpiece 12 is depicted. Furthermore, by an arrow in FIG. 2C, the second movement of the mouthpiece 12 is depicted. In the second movement, the mouthpiece 12 is pivoted by an additional 90°. In FIGS. 2A to 2C, the two 90° movements of the mouthpieces are shown as cumulative, such that the mouthpiece moves by 180° between the first position and the third position. However, it will be appreciated that in some embodiments, the second movement might be in a direction opposite to the direction of the first movement, so that the second movement recloses the heating chamber 14.

The aerosol-generating device comprises a means to realize a functionality during the movement of the mouthpiece 12. In the embodiment depicted in FIG. 2, the means are mechanical means. The mechanical means comprise a crankshaft 24 connected with or proximal to near the hinge 22. The crankshaft 24 is configured to convert a pivotal movement of the mouthpiece 12 to a linear movement. The conversion of the pivotal movement of the mouthpiece 12 to the linear movement during the first movement of the mouthpiece 12 is depicted in FIG. 2B. The linear movement is transferred, preferably by means of a transfer shaft 26, to a lever rod 28. The lever rod 28 is rotatably attached to the main body 10 of the aerosol-generating device. The pivotal movement of the lever rod 28 as a consequence of the pivotal movement of the mouthpiece 12 is also depicted in FIG. 2B.

The lever rod 28 may comprise a piston 30. The piston 30 may extend into the heating chamber 14. The piston 30 may be positioned at the base of the heating chamber 14 in the first position of the mouthpiece 12. The piston 30 may be configured to contact the aerosol-generating article 18, when the aerosol-generating article 18 is received in the heating chamber 14. The piston may be configured to contact a receptacle of the heating chamber 14, which receptacle receives the aerosol-generating article 18. The piston 30 may be configured to eject the used aerosol-generating article 18 at least partly out of the heating chamber 14 during or in response to the first movement of the mouthpiece 12. The piston 30 may be rotatably attached to the lever rod 28 so that the pivotal movement of the lever rod 28 is converted to a linear movement of the piston 30.

During the first movement, access to the heating chamber 14 is facilitated by the pivotal movement of the mouthpiece 12. Furthermore, by means of the mechanical means including the crankshaft 24, the transfer shaft 26, the lever rod 28 and the piston 30, the used aerosol-generating article 18 is partly ejected from the heating chamber 14. Preferably, the first position depicted in FIG. 2A is an operation position of the aerosol-generating device. After the aerosol-generating article 18 is used, the user may want to eject the used aerosol-generating article 18. By moving the mouthpiece 12 to the second position shown in FIG. 2B, partial ejection of the used aerosol-generating article 18 is facilitated. The user may grip the used aerosol-generating article 18 and remove the used aerosol-generating article 18.

The aerosol-generating device depicted in FIGS. 2A, 2B and 2C comprises a reserve receptacle 32. The reserve receptacle 32 is configured to hold a reserve aerosol-generating article 34. As can be seen in FIG. 2, by means of a second piston 36 rotatably connected with the lever rod 28, the new aerosol-generating article 34 may be at least partly ejected from the reserve receptacle 32 in the second position of the mouthpiece 12. A user may, at this second position of the mouthpiece 12, replace the used aerosol-generating article 18 from the heating chamber 14 by the new aerosol-generating article 34 from the reserve receptacle 32.

Although not illustrated in the figures, a locking means may be provided for retaining the mouthpiece 12 in place in the first position. The locking means may be a mechanical locking means. The mechanical locking means may comprise a lip and a detent in the mouthpiece 12 and main body 10, respectively. The lip may engage with the detent in a snap fit, for example. The lip may be a resiliently deformable lip. The resiliently deformable lip may be disengaged from the detent by applying a sufficient force to overcome the snap fit. Although a mechanical lip and detent have been described, it will be appreciated that other locking means may be provided.

FIGS. 3A, 3B and 4A, 4B and 4C show another aspect of the aerosol-generating device. In this aspect, the first movement of the mouthpiece 12 is a pivotal movement around an axis L that is parallel to the longitudinal axis of the aerosol-generating device.

The first position of the mouthpiece 12 is depicted in FIGS. 3A, 4A and 4C. FIGS. 4A and 4B are top views. FIG. 4C is a cut view along the line AA' shown in FIG. 3A. In the first position of the mouthpiece 12, the mouthpiece 12 is locked in place by a locking means. The locking means may comprise a female looking element 38 and a male locking element 40. The main body 10 of the aerosol-generating device may comprise the female looking element 38 and the mouthpiece 12 may comprise the male locking element 40. However, the main body 10 of the aerosol-generating device may also comprise the male looking element 40 and the mouthpiece 12 may also comprise the female looking element 38. Although a male 40 and female 38 locking means have been described, it will be appreciated that other locking means may be provided. For example, the locking means may comprise a lip and detent as described above with reference to the embodiment shown in FIGS. 2A to 2C.

During the first movement, the mouthpiece 12 is rotated so that the male looking element 40 is disengaged from the female looking element 38. The mouthpiece 12 is rotated preferably by around 180°. The first movement is depicted in FIG. 4B.

As can be seen in FIGS. 3A and 3B, the hinge 22 of the mouthpiece 12 is connected with a first sliding shaft 42. The first sliding shaft 42 is configured to slide along a second sliding shaft 44, wherein the second sliding shaft 44 is part of the main body 10 of the aerosol-generating device. The first sliding shaft 42 is connected with a base support 46. The sliding shaft enables the second movement of the mouthpiece 12. The second movement of the mouthpiece 12 is a linear movement. The linear movement is along the axis L. In the linear movement, the mouthpiece 12 is distanced from the main body 10 of the aerosol-generating device. The base support 46 is positioned at the base of the heating chamber 14, when the mouthpiece 12 is in the first position or in the second position. The base support 46 is configured to contact the upstream end of the aerosol-generating article 18, when the aerosol-generating article 18 is received in the heating chamber 14. During the second movement, in which the mouthpiece 12 is moved from the second position to the third position, the base support 46 at least partly ejects the aerosol-generating article 18 from the heating chamber 14. The second movement and the third position of the mouthpiece 12 are depicted in FIG. 3B.

FIG. 4A shows the mouthpiece 12 in the first position, in which the mouthpiece 12 is securely held by the locking means. In FIG. 4B, the mouthpiece 12 is pivoted to the second position such that the used aerosol-generating article 18 becomes accessible. FIG. 4C shows a cut view along the line AA' from FIG. 3A, wherein no aerosol-generating article 18 is received in the heating chamber 14. Consequently, the base support 46 can be seen in FIG. 4C.

The invention claimed is:

1. An aerosol-generating device, comprising:

a main body comprising a heating chamber for receiving an aerosol-forming substrate;

a mouthpiece, wherein the mouthpiece is movably connected to the main body, wherein the mouthpiece is movable with respect to the main body in a first movement between a first position and a second position, wherein the first position is an operation position of the aerosol-generating device and the mouthpiece covers the heating chamber, and wherein the first movement of the mouthpiece from the first position to the second at least partially exposes the heating chamber, wherein the mouthpiece is movable with respect to the main body in a second movement between the second position and a third position, wherein the second movement of the mouthpiece from the second position to the third position is configured to trigger an event, wherein the event comprises at least partial ejection of a used aerosol-generating article from the main body towards the mouthpiece; and a crankshaft connected with the mouthpiece for converting a pivotal movement of the mouthpiece to a linear movement of a lever rod connected to the crankshaft, wherein the lever rod is configured for at least partly facilitating an ejection of the aerosol-generating article from the heating chamber.

2. The aerosol-generating device according to claim 1, wherein when the mouthpiece is in the second position, the device is configured to facilitate at least one or more of the following:

access to the heating chamber;

cleaning of the heating chamber;

display of information regarding the aerosol-generating device; and access to elements of the aerosol-generating device apart from the heating chamber.

3. The aerosol-generating device according to claim 1, wherein the mouthpiece is pivotally attached to the main body.

4. The aerosol-generating device according to claim 3, wherein the first and second movements are a same type of movement.

5. The aerosol-generating device according to claim 1, wherein the first movement and the second movement are different types of movement.

6. The aerosol-generating device according to claim 1, wherein the first movement is a pivotal movement.

7. The aerosol-generating device according to claim 1, wherein the second movement is a pivotal movement.

8. The aerosol-generating device according to claim 6, wherein said pivotal movement comprises a movement of the mouthpiece about a pivoting axis, wherein the pivoting axis is:

a longitudinal axis, which longitudinal axis is an axis along a longitudinal length of the aerosol-generating device; or a transverse axis, which transverse axis is transverse to a longitudinal axis of the device; or a central longitudinal axis of the aerosol-generating device.

9. The aerosol-generating device according to claim 1, wherein the mouthpiece comprises a sliding element, and wherein one of the first and second movements is a pivotal movement and other of the first and second movements is a sliding movement.

10. The aerosol-generating device according to claim 1, wherein the mouthpiece is slidably attached to the main body.

11. The aerosol-generating device according to claim 1, wherein the mouthpiece is configured to trigger the event during or in response to the second movement by using mechanical energy of the first movement.

12. The aerosol-generating device according to claim 1, wherein the aerosol-generating device comprises a power supply and is configured to detect one or more of the first movement and the second movement, and wherein the aerosol-generating device is configured to trigger the event by using electrical energy of the power supply.

13. The aerosol-generating device according to claim 1, wherein the device comprises a temperature sensor configured to measure the temperature inside the heating chamber, and wherein the device comprises a controller configured to prevent one or more of the first movement or a reverse first movement, if the temperature sensor detects that the temperature within the heating chamber exceeds a predetermined threshold.

14. The aerosol-generating device according to claim 6, wherein an angle between the mouthpiece in the first position and the mouthpiece in the second position is 90°.

15. The aerosol-generating device according to claim 7, wherein an angle between the mouthpiece in the second position and the mouthpiece in the third position is 90°.

16. The aerosol-generating device according to claim 3, wherein pivotal movement of the mouthpiece relative to the main body in the second movement between the second position and the third position causes at least partial ejection of the used aerosol-generating article.

17. The aerosol-generating device according to claim 1, wherein the event further comprises any one or more of the following:

at least partial ejection of a heating element of the heating chamber; and at least partial ejection of the heating chamber.

18. The aerosol-generating device according to claim 1, wherein the event further comprises any one or more of the following:

initiation a cleaning cycle of the heating chamber;

initiation of a pyrolysis cleaning cycle of the heating chamber; and initiation of a signal from a controller to output one or more pieces of information on a user interface.

* * * * *